US009545794B2

(12) United States Patent
Cunnington et al.

(10) Patent No.: US 9,545,794 B2
(45) Date of Patent: Jan. 17, 2017

(54) SELECTIVE PURGING OF INK JETS TO LIMIT PURGE MASS

(75) Inventors: James Matthew Cunnington, Tualatin, OR (US); Trevor James Snyder, Newberg, OR (US); Edward F. Burress, West Linn, OR (US); Heidi Noce, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 1281 days.

(21) Appl. No.: 12/431,446

(22) Filed: Apr. 28, 2009

(65) Prior Publication Data

US 2010/0271424 A1 Oct. 28, 2010

(51) Int. Cl.
*B41J 2/165* (2006.01)

(52) U.S. Cl.
CPC ..... *B41J 2/16535* (2013.01); *B41J 2/16526* (2013.01)

(58) Field of Classification Search
None
See application file for complete search history.

(56) References Cited

U.S. PATENT DOCUMENTS

| | | | | |
|---|---|---|---|---|
| 6,565,189 | B2 * | 5/2003 | Yamada et al. | 347/36 |
| 6,913,338 | B2 | 7/2005 | Rhoads et al. | |
| 7,111,917 | B2 | 9/2006 | Hill et al. | |
| 2007/0126783 | A1 | 6/2007 | Deshon-Stepp et al. | |
| 2008/0012897 | A1 * | 1/2008 | Miyazawa | 347/33 |
| 2008/0049066 | A1 * | 2/2008 | Inoue | 347/33 |
| 2008/0218554 | A1 * | 9/2008 | Inoue | 347/33 |

* cited by examiner

*Primary Examiner* — Alejandro Valencia
(74) *Attorney, Agent, or Firm* — Maginot Moore & Beck LLP

(57) ABSTRACT

A method of performing maintenance on a printhead of an imaging device includes the detection of at least one contaminated ink jet in a printhead. A first pressure is applied to ink in the printhead in response to the detection of the at least one contaminated ink jet. The first pressure is configured to prevent ink from entering a plurality of apertures in an aperture plate of the printhead and to prevent ink from drooling from the plurality of apertures unless the apertures are wiped by a wiper blade. A first portion of apertures in the plurality of apertures in the aperture plate is wiped with a wiper blade while leaving a second portion of the apertures untouched by the wiper blade while the first pressure is applied to the ink in the printhead. The wiping of the first portion of apertures enables ink to drool from the first portion of apertures. The first portion of apertures includes the at least one detected contaminated ink jet.

5 Claims, 7 Drawing Sheets

SELECTIVE PURGING OF INK JETS TO LIMIT PURGE MASS

TECHNICAL FIELD

This disclosure relates generally to printheads of an ink jet imaging device, and, in particular, to maintenance methods for use with such printheads.

BACKGROUND

Solid ink or phase change ink printers conventionally receive ink in a solid form, sometimes referred to as solid ink sticks. The solid ink sticks are typically inserted through an insertion opening of an ink loader for the printer, and are moved by a feed mechanism and/or gravity toward a heater plate. The heater plate melts the solid ink impinging on the plate into a liquid that is delivered to a printhead assembly for jetting onto a recording medium. In the direct printing architecture, the recording medium is typically paper, while for an offset printing architecture, the ink is printed onto a liquid layer supported by an intermediate imaging member, such as a metal drum or belt.

A printhead assembly of a phase change ink printer typically includes one or more printheads each having a plurality of ink jets from which drops of melted solid ink are ejected towards the recording medium. The ink jets of a printhead receive the melted ink from an ink supply chamber, or manifold, in the printhead which, in turn, receives ink from a source, such as a melted ink reservoir or an ink cartridge. Each ink jet includes a channel having one end connected to the ink supply manifold. The other end of the ink channel has an orifice, or nozzle, for ejecting drops of ink. The nozzles of the ink jets may be formed in an aperture, or nozzle plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to each other, the deposited drops can be precisely patterned to form particular text and graphic images on the recording medium.

One difficulty faced by fluid ink jet systems is partially or completely blocked ink jets. Partially or completely blocked ink jets may be caused by a number of factors including contamination from dust or paper fibers, dried ink, etc. In addition, when the solid ink printer is turned off, the ink that remains in the print head can freeze. When the printer is turned back on and warms up, the ink thaws in the print head. Air that was once in solution in the ink can come out of solution to form air bubbles or air pockets that can become lodged in the ink pathways of the print head. Partially or completely blocked ink jets can lead to ink jet malfunctions or failures resulting in missing, undersized or misdirected drops on the recording media that degrade the print quality.

Some partially or completely blocked ink jets may be recovered by performing a printhead maintenance action. Print head maintenance generally includes purging ink through the ink pathways and nozzles of a print head assembly in order to clear contaminants, air bubbles, dried ink, etc. from the print head assembly and/or wiping the nozzle plate of the print head assembly. Previously known purging methods required that ink be purged through each ink jet in the printhead regardless of the number or location of non-functional jets in the printhead. If a printhead is purged to recover a single jet, ink is currently moved through all of the jets which requires a larger amount of ink, most of which does not contribute to the recovery of the weak or missing jets. There are currently no means to limit the purging of ink jets to a particular location or number of jets.

SUMMARY

The present disclosure proposes the selective purging of jets such that more (or all) of the ink flowed during purge is used in the specific jet which required recovery. This is done to either increase the efficiency of jet recovery or reduce the amount of ink used for jet recovery (or both). This is done by either using surface energy and wetting characteristics of the aperture plate of a printhead as a valve or by using methods and mechanisms to control which portions and/or jets of the head are purged. In one particular embodiment, a method of performing maintenance on a printhead of an imaging device includes the detection of at least one contaminated ink jet in a printhead. A first pressure is applied to ink in the printhead in response to the detection of the at least one contaminated ink jet. The first pressure is configured to prevent ink from entering a plurality of apertures in an aperture plate of the printhead and to prevent ink from drooling from the plurality of apertures unless the apertures are wiped by a wiper blade. A first portion of apertures in the plurality of apertures in the aperture plate is wiped with a wiper blade while leaving a second portion of the apertures untouched by the wiper blade while the first pressure is applied to the ink in the printhead. The wiping of the first portion of apertures enables ink to drool from the first portion of apertures. The first portion of apertures includes at least one of the contaminated ink jet(s).

In another embodiment, a method of performing printhead maintenance includes the detection of at least one contaminated ink jet in a printhead. A first pressure is applied to ink in the printhead in response to the detection of the at least one contaminated ink jet. The first pressure is configured to prevent ink from entering a plurality of apertures in an aperture plate of the printhead and to prevent ink from drooling from the plurality of apertures when ink jets of the printhead are not actuated. At least one detected contaminated ink jet is then actuated while the first pressure is being applied to the printhead to enable ink to drool from the at least one detected contaminated ink jet.

In yet another embodiment, a method of performing maintenance on a printhead of an imaging device includes detecting at least one contaminated ink jet in a printhead. A first pressure is applied to ink in the printhead in response to the detection of the at least one contaminated ink jet. The first pressure is configured to prevent ink from entering a plurality of apertures in an aperture plate of the printhead and to prevent ink from drooling from the plurality of apertures. A wiper blade is moved into contact with the aperture plate in front of the at least one detected contaminated jet to cause ink to drool from the first portion of the apertures in the aperture plate. The first portion of apertures includes the at least one detected contaminated ink jet. The wiper blade is configured to catch or divert ink drooled from the first portion of the apertures and to prevent drooled ink from reaching apertures in the aperture plate below the first portion of apertures.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
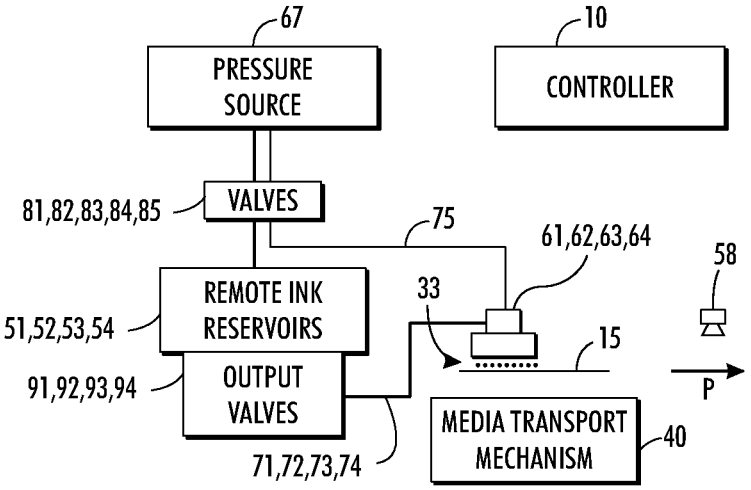
FIG. 1 is a schematic block diagram of an embodiment of an ink jet printing apparatus that includes on-board ink reservoirs.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is transferred moves through the imaging device. The cross-process direction, along the same plane as the image receiving surface, is substantially perpendicular to the process direction.

Figure 2:
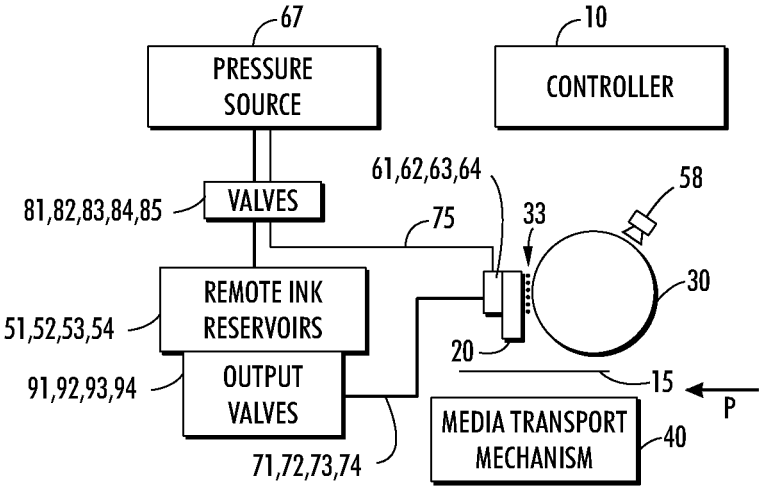
FIG. 2 is a schematic block diagram of another embodiment of an ink jet printing apparatus that includes on-board ink reservoirs.

FIGS. 1 and 2 are schematic block diagrams of an embodiment of an ink jet printing apparatus that includes a controller 10 and a printhead 20 that may include a plurality of drop emitting drop generators for emitting drops of ink 33 either directly onto a print output medium 15 or onto an intermediate transfer surface 30. A print output medium transport mechanism 40 may move the print output medium in a process direction P relative to the printhead 20. The printhead 20 receives ink from a plurality of on-board ink reservoirs 61, 62, 63, 64 which are attached to the printhead 20. The on-board ink reservoirs 61-64 respectively receive ink from a plurality of remote ink containers 51, 52, 53, 54 via respective ink supply channels 71, 72, 73, 74.

Although not depicted in FIG. 1 or 2, ink jet printing apparatus includes an ink delivery system for supplying ink to the remote ink containers 51-54. In one embodiment, the ink utilized in ink jet printing apparatus is a "phasechange ink," by which is meant that the ink is substantially solid at room temperature and substantially liquid when heated to a phase change ink melting temperature for jetting onto an imaging receiving surface. Accordingly, the ink delivery system comprises a phase change ink delivery system that has at least one source of at least one color of phase change ink in solid form. The phase 9 change ink delivery system also includes a melting and control apparatus (not shown) for melting the solid form of the phase change ink into a liquid form and delivering the melted ink to the appropriate remote ink container. The phase change ink melting temperature may be any temperature that is capable of melting solid phase change ink into liquid or molten form. In one embodiment, the phase change ink melting temperate is approximately 100° C. to 140° C. In alternative embodiments, however, any suitable marking material or ink may be used including, for example, aqueous ink, oil-based ink, UV curable ink, or the like and may or may not need to be melted to achieve the correct properties for jetting.

The remote ink containers 51-54 are configured to communicate melted phase change ink held therein to the on-board ink reservoirs 61-64. In one embodiment, the remote ink containers 51-54 may be selectively pressurized, for example by compressed air that is provided by a pressure 67 via a plurality of valves 81, 82, 83, 84. The flow of ink from the remote containers 51-54 to the on-board reservoirs 61-64 may be under pressure or by gravity, for example. Output valves 91, 92, 93, 94 may be provided to control the flow of ink to the on-board ink reservoirs 61-64. The pressure source may be configured to deliver air under pressure to the on-board reservoir at a plurality of different pressure levels. The plurality of pressure levels may be provided by using a variable speed air pump and/or by controlling valve 85 to bleed off pressure from the pressure supplied by the air pump until a desired pressure level is reached. As explained below, the plurality of pressure levels include at least a purge pressure and an assist pressure.

The on-board ink reservoirs 61-64 may also be selectively pressurized, for example by selectively pressurizing the remote ink containers 51-54 and pressurizing an air channel 75 via a valve 85. Alternatively, the ink supply channels 71-74 may be closed, for example by closing the output valves 91-94, and the air channel 75 may be pressurized. The on-board ink reservoirs 61-64 may be pressurized to perform a cleaning or purging operation on the printhead 20, for example. The on-board ink reservoirs 61-64 and the remote ink containers 51-54 may be configured to contain melted solid ink and may be heated. The ink supply channels 71-74 and the air channel 75 may also be heated.

The on-board ink reservoirs 61-64 are vented to atmosphere during normal printing operation, for example by controlling the valve 85 to vent the air channel 75 to atmosphere. The on-board ink reservoirs 61-64 may also be vented to atmosphere during non-pressurizing transfer of ink from the remote ink containers 51-54 (i.e., when ink is transferred without pressurizing the on-board ink reservoirs 61-64).

FIG. 2 is a schematic block diagram of an embodiment of an ink jet printing apparatus that is similar to the embodiment of FIG. 1, and includes a transfer drum 30 for receiving the drops emitted by the printhead 20. A print output media transport mechanism 40 engages an output print medium 15 against the transfer drum 30 to cause the image printed on the transfer drum to be transferred to the print output medium 15.

Figure 3:
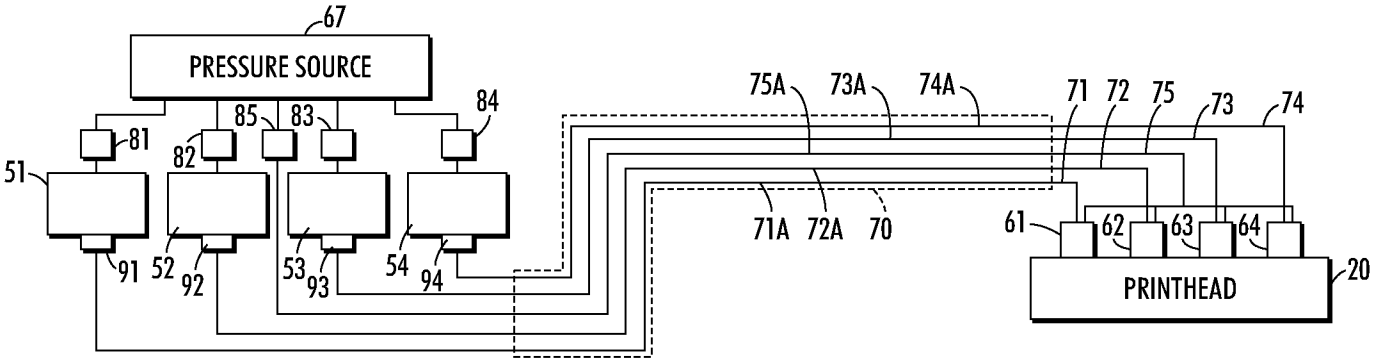
FIG. 3 is a schematic block diagram of an embodiment of ink delivery components of the ink jet printing apparatus of FIGS. 1 and 2.

As schematically depicted in FIG. 3, a portion of the ink supply channels 71-74 and the air channel 75 may be implemented as conduits 71A, 72A, 73A, 74A, 75A in a multi-conduit cable 70.

Figure 4:
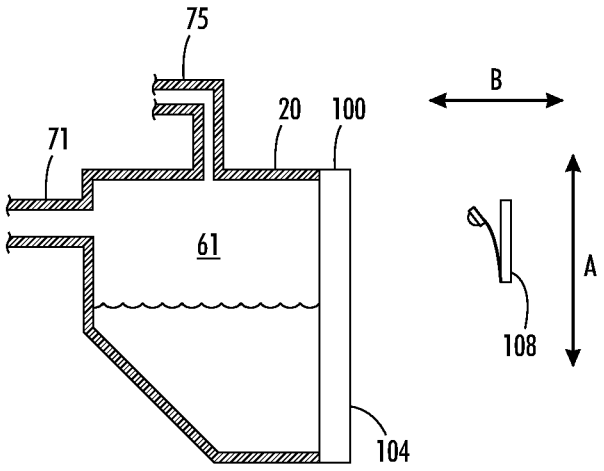
FIG. 4 is a simplified side cross-sectional view of an embodiment of a printhead.

Once pressurized ink reaches a printhead via an ink supply channel, it is collected in the on-board reservoir. The on-board reservoir is configured to communicate the ink to a jet stack 100 that includes a plurality of ink jets (not shown) for ejecting the ink onto a print medium (FIG. 1) or an intermediate transfer member such as transfer drum 30 (FIG. 2). FIG. 4 shows an embodiment of a printhead 20 including at least one on-board reservoir 61 and a jet stack 100. The jet stack 100 can be formed in many ways, but in this example, it is formed of multiple laminated sheets or plates, such as stainless steel plates. Cavities etched into each plate align to form channels and passageways (not shown) that define the ink jets for the printhead. An outer plate comprises the aperture plate 104 that includes a plurality of apertures (not shown) corresponding to each ink jet through which drops of ink are emitted. During operation, ink from the on-board printhead reservoir 61 fills the ink manifolds, inlet channels, pressure chambers, and outlet channels of the ink jets and forms a meniscus (not shown) at each aperture prior to being expelled from the apertures in the form of a droplet. The meniscus of the melted ink is maintained at the apertures of the printhead and prevented from leaking or drooling from the apertures by controlling the surface properties of the aperture plate as well as the use of a slightly negative pressure, i.e., back pressure, to the ink inside the reservoir. As used herein, the term "drooling" refers to the emission or leakage of ink from one or more apertures of a printhead at any time other than when the ink jet aperture is actuated to emit a drop of ink. The back pressure is usually in the range of −0.5 to −5.0 inches of water. Any suitable method or device may be used to provide the slight negative pressure required to maintain the ink at the nozzles. For example, as is known in the art, the positioning of the on-board reservoirs with respect to the jetstack and the dimensioning of the ink chambers and passageways in the on-board reservoirs and jetstacks of the printhead may be selected to provide the requisite back pressure to pinning the ink menisci at the apertures and to prevent ink from drooling from the apertures.

One difficulty faced by fluid ink jet systems is ink jet contamination, also referred to herein as contaminated jets. As used herein, the term "contaminated jets" is used to refer to ink jets that are partially or completely blocked as a result of contamination, such as paper dust and debris particles, in and around the corresponding apertures in the aperture plate. In order to recover from and/or prevent contaminated jets, imaging devices may include a maintenance system for periodically performing a maintenance procedure on the printhead(s). Maintenance procedures typically include purging ink through apertures of the printhead, also referred to as burping, and wiping the aperture plate to remove ink and debris from the surface of the aperture plate. In order to purge ink from the printhead of FIG. 4, a purge pressure may be applied to ink in the on-board printhead reservoir 61 using the pressure source (i.e., air pump) 67 through an opening, or vent, operably coupled to the air channel 75 (FIGS. 1-3). As used herein, the term "purge pressure" refers to the pressure applied to ink in an on-board reservoir that is configured to cause ink in the reservoir to discharge through the apertures in the aperture plate 104. Purge pressures are typically a few to several psi, and, in one embodiment, is approximately 4.1 psi. After ink is purged through the apertures of the printhead, a scraper or wiper blade 108 may be drawn across the aperture plate 140 to squeegee away any excess liquid phase change ink, as well as any paper, dust or other debris that has collected on the aperture plate 140.

The wiper blade and/or the printhead may include a positioning system (not shown) that enables the wiper blade and/or the printhead to be moved with respect to each to perform a wiping procedure. As used herein, the term "wiping procedure" or "wiping" with respect to the aperture plate refers to the process of moving the wiper into contact with the aperture plate at a first location, e.g., above the apertures in the aperture plate, and drawing the wiper blade across the surface of the aperture plate to a second location on the aperture plate, e.g., below the apertures in the aperture plate. To enable a wiping procedure, either or both of the wiper blade and the printhead may be configured for movement so that the wiper blade 108 may be moved toward and away from the aperture plate 104 along an axis B substantially normal to the aperture plate into and out of contact with the aperture plate. In addition, the positioning system enables relative movement of the wiper along an axis A substantially parallel to the front surface of the aperture plate so that the wiper may be moved into and out of contact with the aperture plate. The wiper may be moved into and out of contact with the aperture plate at a plurality of locations along the axis A to enable dabbing procedures. As used herein, the term "dabbing" or "dabbing procedure" refers to the process of moving the wiper blade into and out of contact with an aperture plate of a printhead in an effort to remove debris particles from the wiper blade. Wiper dabbing may be performed at any suitable time such as before and/or after a wiping procedure. The wiper blade may be dabbed against the aperture plate at any suitable location on the aperture plate, such as below the apertures.

The positioning system is also configured to move the wiper blade into and out of contact with the aperture plate at a plurality of locations along the axis A to enable partial wiping of the aperture plate as well as the formation of a purge dam that may be used to facilitate selective purging of certain ink jets. As used herein, the terms "partial wiping," "partial wipe," and equivalents thereof refers to the process of performing a wiping procedure on a select portion of the aperture plate. A partial wiping procedure may be utilized to wipe, for example, as few as one or two rows of nozzles, or half of aperture plate or more. The term "purge dam" refers to the process of moving the wiper blade into contact with the aperture plate at a predetermined location in front of the apertures of the aperture plate for a predetermined duration. As explained below, the wiper blade used as a purge dam catches ink drooled from select apertures while preventing drooled ink from reaching apertures in the aperture plate below the select apertures.

To prevent ink and debris from being pushed back into the printhead via the apertures during wiping, the pressure source 67 may also be configured to deliver a low pressure assist (i.e., "LPA" or "assist") pressure to the on-board reservoir 61 of the printhead. As used herein, an assist pressure is a pressure applied to the ink in an on-board reservoir that is configured to maintain the meniscus of ink at the apertures during a wiping procedure thus preventing ink from being sucked into the apertures during a wiping procedure. The assist pressure may be any suitable pressure level capable of impeding the flow of ink into the apertures. In one embodiment, the assist pressure is approximately about 0.25 to about 1.5 inches of water.

Previously known purging methods required that ink be purged through each ink jet in the printhead. Often, however, printheads may have only one or a few contaminated jets at any given time. While purging ink through each ink jet aperture may be effective in recovering contaminated ink jets, the ink mass moved through uncontaminated jets, i.e., jets that are working as intended, does not contribute to the recovery of the contaminated jets and is effectively wasted. Therefore, the efficiency of contaminated jet recovery may be increased if the total number of jets purged can be reduced. Accordingly, as an alternative to purging each and every ink jet of a printhead during a purge procedure, the present disclosure proposes the selective purging of ink jets to increase the efficiency of jet recovery for a given amount of purged ink by either using surface energy and wetting characteristics as a valve or by using methods and mechanisms to control which portions and/or jets of the head are purged.

According to one embodiment, a selective purging method involves controlling the jets which expel ink by controlling the pressure to the head and the portion of the head which is wiped prior to the purge. Tests have shown that under some pressures, printheads may drool ink from the apertures during or after being wiped, but not before the wipe. As used herein, the term "selective purge pressure" is a pressure applied to the ink in a printhead that is configured to prevent ink from escaping or being emitted from the apertures prior to performing a wiping procedure and to enable ink to escape or be emitted from the apertures after the apertures are wiped by the wiper blade. In one embodiment, the selective purge pressure is approximately 1.5 in H2O although the selective purge pressure may be any suitable pressure level. The selective purge pressure may be applied to ink in the on-board printhead reservoir 61 using the pressure source 67 and controlling valve 85. Once the printhead is pressurized at the selective purge pressure level, the ink jets of the printhead may be selectively purged by controlling which apertures or locations on the aperture plate are wiped by the wiper blade. As mentioned above, the wiping system is configured to perform a partial wiping procedure that may include a wipe of as few as one or two rows of nozzles or apertures in the apertures plate.

Figure 5:
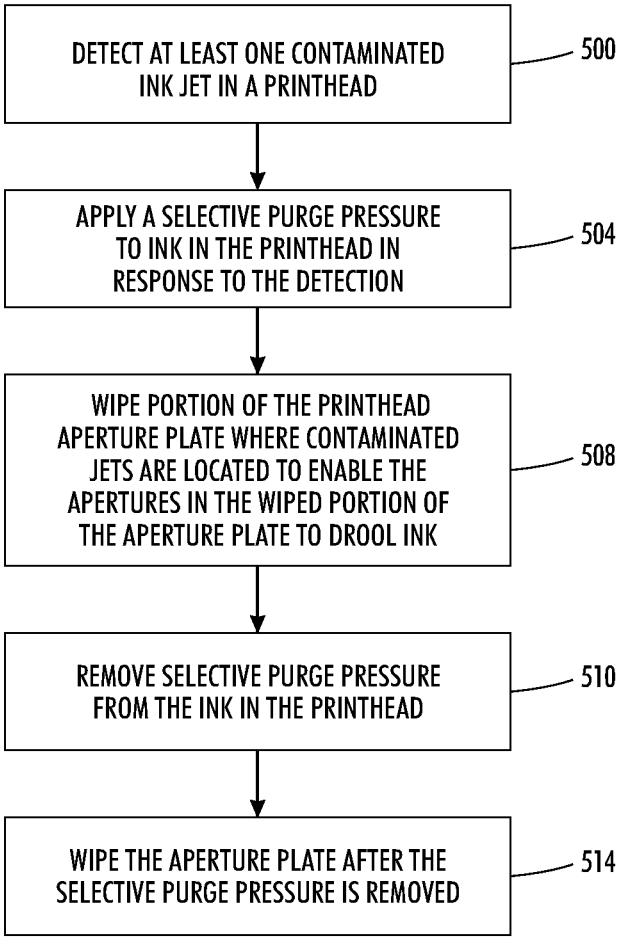
FIG. 5 is a flowchart of a method for selectively purging a printhead such as the printhead of FIG. 4.

FIG. 5 is a flowchart of an embodiment of a method of selectively purging the ink jets of a printhead that utilizes the selective purge pressure and partial wiping of the jets to control which ink jets are purged during a purge process. The method of FIG. 5 begins with the detection of at least one contaminated ink jet (block 500). Methods and systems for detecting contaminated jets are known in the art. In one embodiment, contaminated ink jets may be detected using an inline image sensor 58 (FIGS. 1 and 2). The inline image sensor is in communication with controller 10 and is configured to generate signals indicative of, for example, the presence, intensity, and/or location of ink drops jetted onto the receiving member by the inkjets of the print head assembly. In one embodiment, the image sensor includes a light source (not shown) and a light sensor (not shown). The light source may be actuated by the controller to direct light onto marks formed as part of an image or test pattern on the media sheet (FIG. 1) or the transfer surface (FIG. 2). The reflected light is measured by the light sensor. The signals indicative of the magnitude of the reflected light may be processed by the controller 10 in a known manner to determine the number and location of contaminated ink jets in a printhead. As an alternative to the use of an inline image sensor, contaminated jets may be detected by printing test prints and using an external scanner to scan the test prints to detect contaminated jets or by direct viewing and identification by a customer.

Once at least one contaminated ink jet has been detected, the selective purge pressure may be applied to the ink in the printhead (block 504). As mentioned, the selective purge pressure is configured to prevent ink from entering a plurality of apertures in an aperture plate of the printhead during a wiping procedure and to prevent ink from drooling from the plurality of apertures unless the apertures are wiped by a wiper blade. Once the selective purge pressure has been applied to the ink in the printhead, a partial wiping procedure may be performed to wipe a first portion of the aperture plate with the wiper blade while leaving a second portion of the apertures untouched by the wiper blade (block 508). The first portion of the aperture plate includes the at least one detected contaminated ink jet. The wiping of the first portion of apertures enables ink to drool from the first portion of apertures (including the contaminated jet(s)) while the apertures in the second portion of the aperture plate do not drool. The partial wipe may be performed on at least one row of apertures in the aperture plate that include the at least one detected contaminated ink jet. In one embodiment, the partial wipe is performed on two rows of apertures in which the contaminated jet(s) is/are located. Once the partial wipe has been performed, the selective purge pressure may be removed (block 510) and a partial or full wiping procedure may be performed on the aperture plate without the selective purge pressure applied to the ink in the printhead (block 514).

Figure 8:
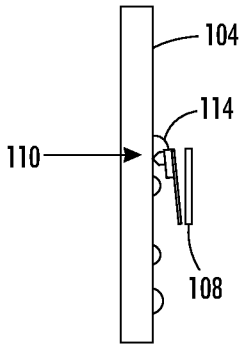
FIG. 8 is a side schematic view of a wiper blade being used as a purge dam.
Figure 9:
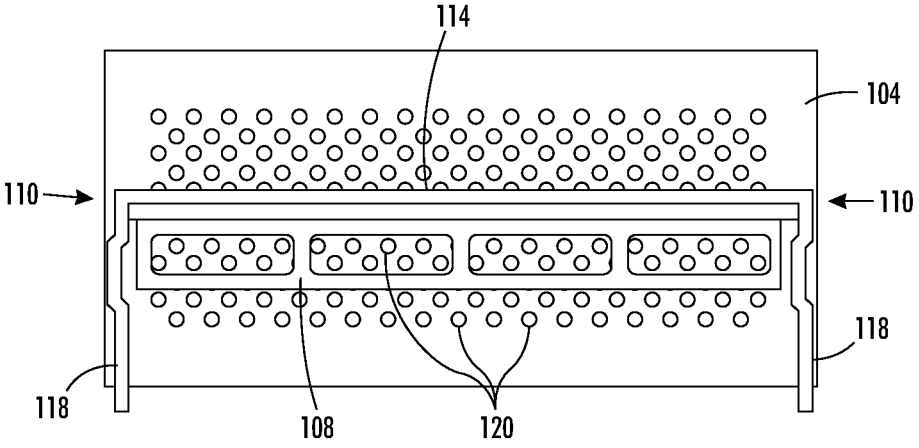
FIG. 9 is a front schematic view of a wiper blade being used as a purge dam.

According to another embodiment, a selective purging method involves controlling the jets which expel ink by applying the selective purge pressure to the ink in the printhead and using the wiper blade as a purge dam to cause ink to drool from select apertures in the aperture plate. FIGS. 8 and 9 schematically depict the wiper blade being used as a purge dam. As mentioned above, the wiper blade 108 may be moved into contact with the aperture plate at a predetermined location to form a purge dam. In the embodiment of FIGS. 8 and 9, during a selective purge process, the wiper blade 108 may be moved into contact with the aperture plate 104 directly in front of the row of apertures 110 that includes one or more contaminated ink jets. When used as a purge dam, the wiper blade 108 holds ink 114 directly over row of apertures 110. The apertures covered by the ink 114 drool at a lower pressure compared to the apertures not covered by ink. In addition, the wiper blade 108 used as a purge dam catches ink drooled 114, 118 from the select apertures while preventing drooled ink from reaching apertures 120 in the aperture plate below the drooling apertures 110. Therefore, the wiper in this embodiment is used to both control which portion of the apertures drool ink as well as to keep the drooled ink away from other jets so they will not start to drool, also.

Figure 6:
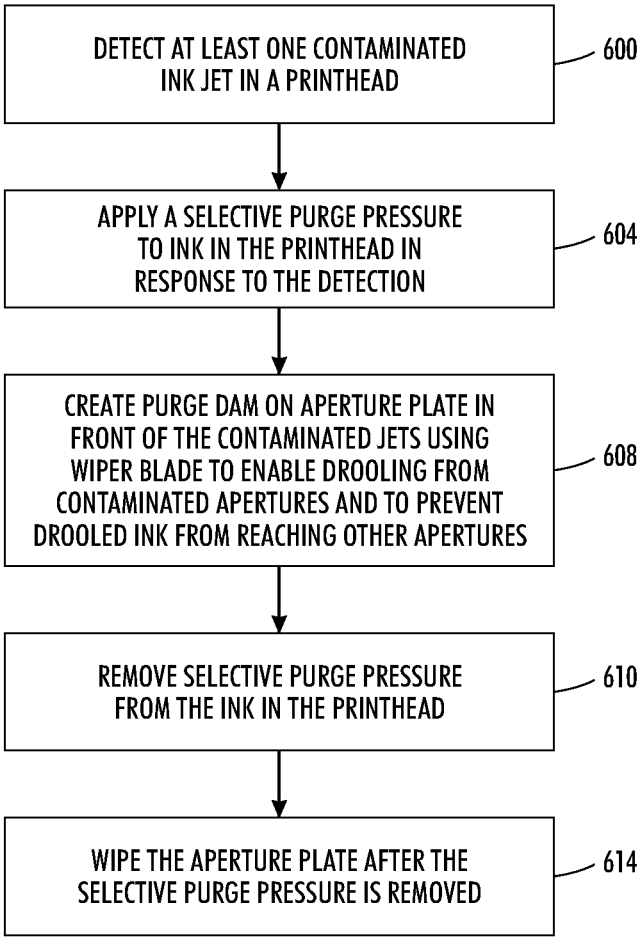
FIG. 6 is a flowchart of another embodiment of a method for selectively purging a printhead such as the printhead of FIG. 4.

FIG. 6 is a flowchart of an embodiment of a method of selectively purging the ink jets of a printhead that utilizes the selective purge pressure and the use of the wiper blade as a purge dam to control which apertures drool ink. Similar to above, the method of FIG. 6 may begin with the detection of at least one contaminated ink jet (block 600) using, for example, the inline image sensor 58 or an external scanner. Once at least one contaminated ink jet has been detected, the selective purge pressure may be applied to the ink in the printhead (block 604) after which the wiper blade may be pressed against the aperture plate to form a purge dam at a location in front of at least one row of apertures in the aperture plate that includes the at least one contaminated ink jet. Contact between the wiper blade and the apertures causes ink to drool from the at least one contaminated aperture. The purge dam catches the ink drooled from the contacted apertures first portion of the apertures and prevents drooled ink from reaching apertures in the aperture plate below the first portion of apertures. Once the partial wipe has been performed, the selective purge pressure may be removed (block 608), lowered, or held constant while and a partial or full wiping procedure may be performed on the aperture plate (block 614). The pressure from 604 would be set based on the initiation of drooling in order to recover the failed jet. The LPA pressure during the wipe could be different and would be set based on the requirement to avoid ink and/or debris from entering the apertures.

According to another embodiment, a selective purging method involves controlling the jets which expel ink by pressurizing a printhead and actuating select jets while the head is pressurized to augment the process of wetting the surface around a specific aperture or apertures to cause ink to drool from the select apertures. Pressurization of the printhead and select actuation of jets enables the purging of a specific bad jet or a very few number of jets. In this embodiment, the pressure applied to the printhead may correspond to the assist pressure described above that is configured to deter ink from entering through the aperture plate. By actuating certain jets with an assist pressure applied to the ink in the printhead, the actuated jets emit ink which wets the aperture enabling the actuated jets to begin to drool ink.

Figure 7:
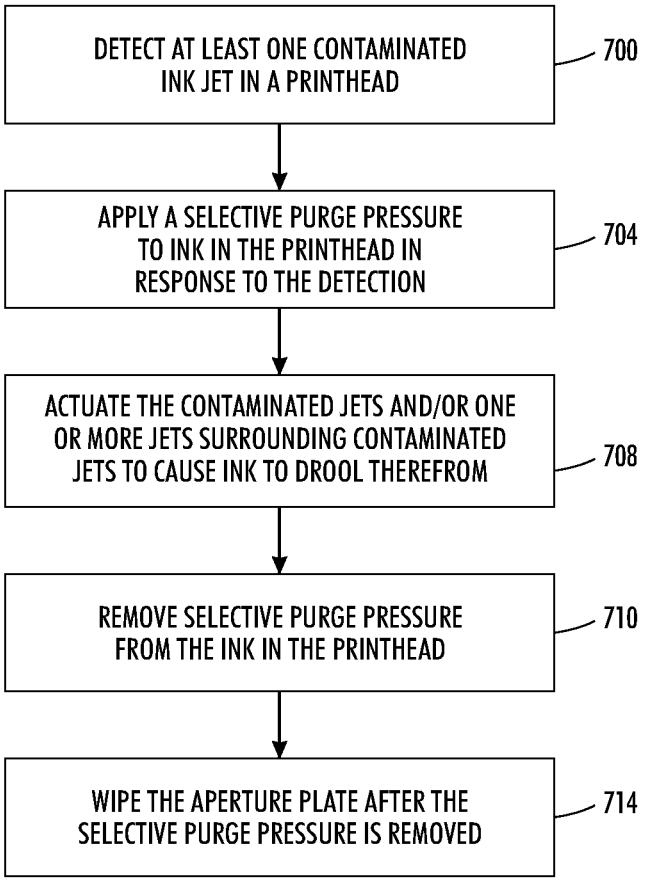
FIG. 7 is a flowchart of yet another embodiment of a method for selectively purging a printhead such as the printhead of FIG. 4.

FIG. 7 is a flowchart of an embodiment of a method of selectively purging the ink jets of a printhead that utilizes the pressurization of the printhead and the select actuation of the jets to control which apertures drool ink. Similar to above, the method of FIG. 7 may begin with the detection of at least one contaminated ink jet (block 700) using, for example, the inline image sensor 58 or an external scanner. Once at least one contaminated ink jet has been detected, the selective purge pressure may be applied to the ink in the printhead (block 704). After the selective purge pressure is applied, at least one contaminated jet is actuated to enable ink to drool from the contaminated ink jet (block 708). As an alternative to actuating the contaminated jet, one or more ink jets around the contaminated jet may be actuated such as ink jets above or to the side of the contaminated jets. To facilitate the drooling of ink from only select apertures, the wiper blade may be used to form a purge dam in front of the contaminated jets prior to jet actuation. The purge dam can catch the ink drooled from the actuated jets and prevent ink from being drooled onto apertures below the actuated jets. In any event, once the select apertures have been actuated and ink drooled therefrom, the selective purge pressure may be removed or adjusted (block 710) and a partial or full wiping procedure may be performed on the aperture plate without the selective purge pressure applied to the ink in the printhead (block 714).

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of performing maintenance on a printhead of an imaging device, the method comprising:

detecting at least one contaminated ink jet in a printhead;

applying a first pressure to ink in the printhead in response to the detection of the at least one contaminated ink jet, the first pressure being greater than atmospheric pressure to prevent ink from entering a plurality of apertures arranged in a plurality of rows in an aperture plate of the printhead while the first pressure alone forms and maintains a meniscus of ink at the apertures in the aperture plate, each aperture in the plurality of apertures being in fluid communication with an ink jet in the printhead, and to prevent ink from being emitted from the plurality of apertures unless the apertures are physically contacted; and moving while the first pressure alone is applied to the ink in the printhead a wiper blade to a first position on the aperture plate to physically contact the meniscus of ink formed and maintained by the first pressure alone at the apertures in a row of apertures in which an aperture corresponding to the at least one contaminated ink jet is located, the wiper blade being configured to move from a position where the wiper blade is disengaged from the aperture plate to any one aperture row in the plurality of rows arranged in the aperture plate.

2. The method of claim 1 further comprising:

holding the wiper blade at the first position to enable the apertures in the row of apertures to drool and to form a purge dam that catches the ink drooled by the apertures in the row of apertures in which the at least one contaminated ink jet is located to prevent the ink drooled by the apertures in the row in which the at least one contaminated ink jet is located from reaching another row of apertures on the aperture plate.

3. The method of claim 2 further comprising:

removing the first pressure from the ink in the printhead after the wiper blade catches the ink drooled by the apertures in the row of apertures in which the at least one contaminated ink jet is located.

4. The method of claim 3 further comprising:

moving the wiper blade to a location on the aperture plate that is below the row of apertures in which the at least one contaminated ink jet is located to wipe only a portion the aperture plate after the first pressure is removed from the ink in the printhead.

5. The method of claim 2, the ink comprising melted phase change ink.

* * * * *